United States Patent [19]

Swensen

[11] 4,426,824

[45] Jan. 24, 1984

[54] FLOOR PANEL AND METHOD OF MAKING SAME

[75] Inventor: Eugene L. Swensen, Laurel, Md.

[73] Assignee: Donn Incorporated, Westlake, Ohio

[21] Appl. No.: 264,932

[22] Filed: May 18, 1981

[51] Int. Cl.[3] ..... B32B 3/12; E04C 2/32

[52] U.S. Cl. ..... 52/794; 29/455 LM; 428/132

[58] Field of Search ..... 52/792, 263, 793, 126.6, 52/806, 794, 829, 811, 675; 411/467; 428/178–180, 132, 134, 136; 228/181; 244/119; 29/455 ML

[56] References Cited

U.S. PATENT DOCUMENTS

| | | | |
|---|---|---|---|
| 2,391,997 | 1/1946 | Noble | 52/792 |
| 2,974,378 | 3/1961 | Lidsky | 411/467 |
| 3,008,551 | 11/1961 | Cole | 52/794 |
| 3,090,088 | 5/1963 | Foley | 411/467 |
| 3,236,018 | 2/1966 | Graham | 52/794 |
| 3,419,457 | 12/1968 | Bleasdale | 428/180 |
| 3,876,492 | 4/1975 | Schott | 52/792 |
| 3,938,963 | 2/1976 | Hale | 52/792 |

FOREIGN PATENT DOCUMENTS

| | | | |
|---|---|---|---|
| 168616 | 9/1921 | United Kingdom | 52/794 |

*Primary Examiner*—John E. Murtagh

*Attorney, Agent, or Firm*—Pearne, Gordon, Sessions, McCoy, Granger & Tilberry

[57] ABSTRACT

An elevated floor panel is disclosed formed of a sheet metal upper surface member and a sheet metal lower support member. The lower support member is provided with a plurality of apertures arranged in perpendicular rows across the panel. Integral legs formed of material displaced from the apertures are symmetrically arranged around each aperture and extend laterally to the upper surface member. Each leg is provided with a foot portion welded to the under surface of the surface member. The edges of the lower support member are bent laterally to provide sidewalls extending to the upper surface member and terminating in flanges welded to the upper surface member. The panel structure permits the panel to be supported at its corners and to sustain substantial loads with small load-induced deflections.

8 Claims, 6 Drawing Figures

FLOOR PANEL AND METHOD OF MAKING SAME

BACKGROUND OF THE INVENTION

This invention relates generally to floor structures, and more particularly to a novel and improved floor panel for elevated access floors and to a method of producing the same.

Prior Art

Elevated access floors are often used in computer areas or the like to provide an underfloor space for electrical connections and for ventilating air. Such floors often provide rectangular or square panels which are supported on pedestals at their corners. The panels must provide substantial strength and rigidity so that they can support heavy equipment loads. Further, they should be light in weight for easy installation and removal and to reduce the material costs of their manufacture. Examples of such floors are disclosed in U.S. Pat. Nos. 3,696,578 and 4,067,156 (assigned to the assignee of this invention).

SUMMARY OF THE INVENTION

The present invention provides a novel and improved floor panel for access floors or the like. The illustrated panel is square and provides a substantially rigid, flat upper surface member and a lower support member, also formed of sheet material. The two sheets are metal in the illustrated embodiment.

The support member is spaced from and parallel to the surface member and is formed with a pattern of apertures or openings arranged in perpendicular rows. Integral legs are formed from the material displaced from the apertures and are symmetrically located around the aperture. Such legs extend to the upper surface member, and each leg is formed with a flange or foot which is welded to the upper surface member. Each leg is formed with a cross curvature for increased strength and rigidity.

The edges of the support member are bent upwardly and joined to the underside of the upper sheet to provide a boxlike structure. The pattern and size of the openings are arranged to leave a substantial support member in a plane spaced from the surface member so that the supporting and stiffening function of the support member is not materially reduced. Further, the connecting legs are arranged in a relatively closely spaced pattern along substantially the entire area of the panel to provide a superior interconnection between the members so that improved strength and rigidity are achieved. In effect, the panel provides a box beam type structure which is capable of supporting large loads at substantially any location on the upper surface member, with very low load-induced deflections. Futher, because of the efficiency of the structure, the panel can be formed of relatively thin sheet material to reduce its material cost and weight. Still further, the panel structure is arranged for manufacture with very little scrap to provide an efficient use of material.

These and other aspects of this invention are illustrated in the drawings, and are more fully described in the following splecification.

DETAILED DESCRIPTION OF THE PREFERRED EMBODIMENT

Figure 1:
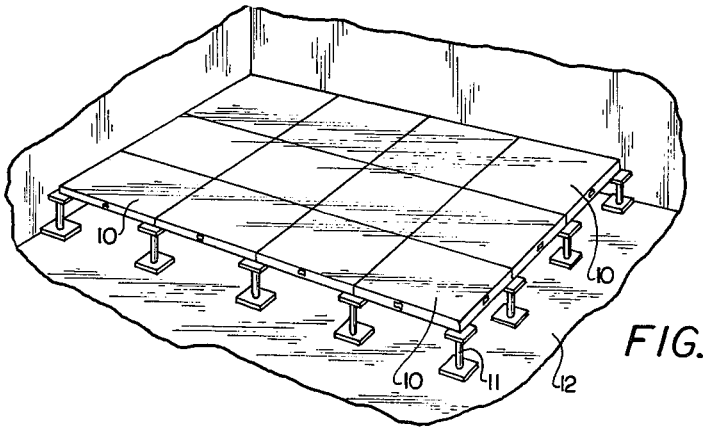
FIG. 1 is a fragmentary, perspective view schematically illustrating the manner in which an elevated floor consisting of discrete panels is supported on pedestals at the panel corners.

Referring to the drawings, FIG. 1 schematically illustrates a typical elevated floor structure in which a plurality of rectangular or square panels 10 are supported at their corners on pedestals 11 at a location above the building floor 12. A typical pedestal for such elevated floors is illustrated in U.S. Letters Pat. No. 4,113,219. Normally, pedestals are located at the intersections between the panels and, except along walls, the corners of four adjacent panels are supported by a single pedestal.

Figure 2:
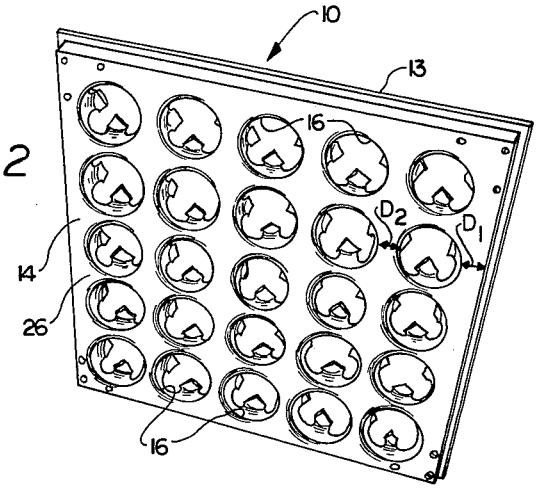
FIG. 2 is a perspective view of a panel incorporating the present invention, illustrating the underside thereof.
Figure 3:
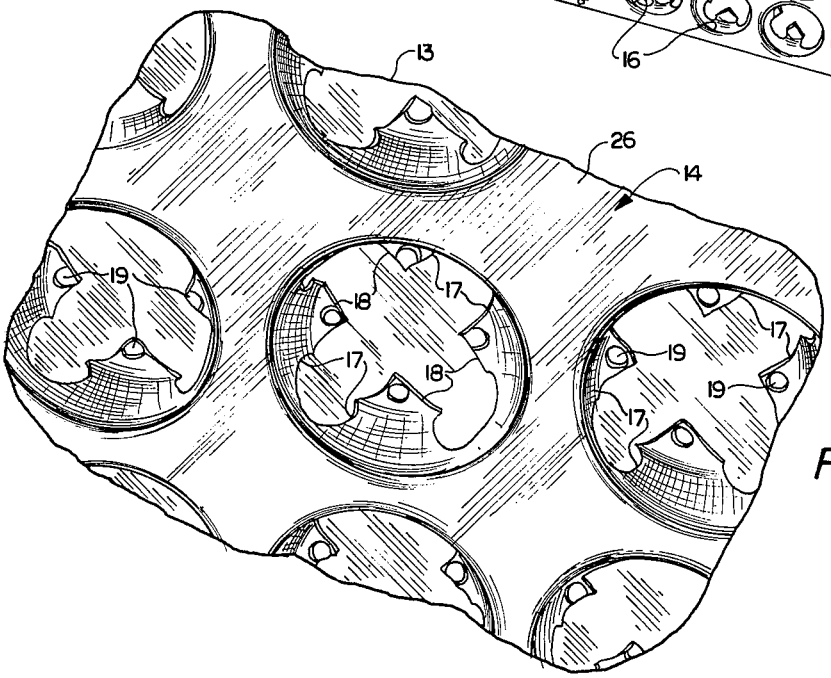
FIG. 3 is an enlarged, fragmentary, perspective view illustrating the general structure of the lower support member and its connection to the upper surface member.
Figure 4:
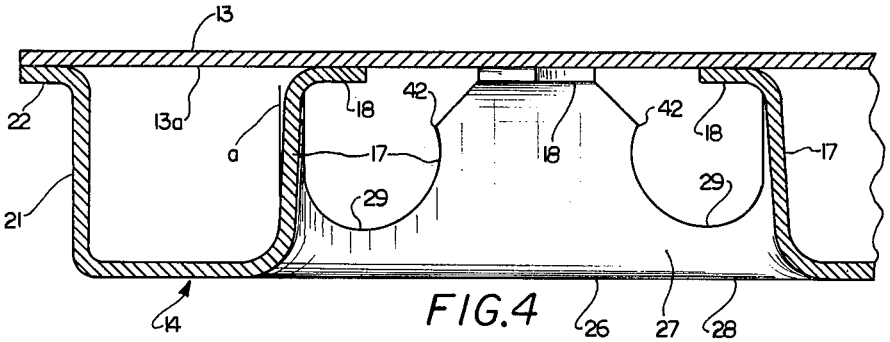
FIG. 4 is a fragmentary side elevation, partially in section, illustrating the structure around a typical aperture.

A panel in accordance with this invention is illustrated in FIGS. 2 through 4. Such panel includes an upper surface member 13 formed of a single square piece of substantially rigid sheet material. Attached to the underside of the upper surface member is a lower support member 14 which is also formed of a substantially rigid sheet material. In the illustrated embodiment, both members 13 and 14 are sheet metal. The lower support member 14 is formed with a plurality of circular apertures or openings 16 arranged in an array to provide rows of aligned openings extending in both directions across the panel. In the illustrated panel, there are 25 openings 16 arranged to provide five rows of openings extending across the panels between each pair of opposed side edges.

The openings are formed in the manner described in greater detail below, to provide four symmetrically arranged legs 17 which are integral with the lower support member and extend laterally toward the upper surface member 13. A flange or foot 18 is provided at the upper end of each of the legs 17 and extends along the under surface **13*a* of the upper surface member 13. Each of the feet 18 is rigidly secured to the upper surface member by suitable means, such as spot welds or the like, illustrated at 19 in FIG. 3**.

The edges of the support member 14 are bent upward to provide vertical walls 21 extending to the under surface 19 of the upper surface member and terminating at a flange 22 secured to the upper surface member by welding or the like to provide a rigid connection therebetween.

With this structure, the upper surface member and the lower support member cooperate to provide a system which in effect is a box beam. The portion 26 of the lower support member between the openings lies along a plane spaced from and parallel to the plane of the upper surface member 13, and the legs 17 and the walls 21 cooperate to maintain this uniform spacing. Since the walls 21 extend completely around the panel, they provide very good support between the two members along the entire periphery of the panel. Further, the legs 17 are closely spaced in a pattern which covers substantially the entire panel and provides, in the illustrated embodiment, 100 lateral connections between the two surface members. Such lateral connections cooperate with full edge connections to maintain the uniform spacing between the members along the entire panel.

Ideally, in a box beam system of the general type involved here, the upper surface material would be uninterrupted and the lower surface material would also be uninterrupted. In addition, a support system would be provided to maintain a uniform spacing between the upper and lower surfaces throughout the panel. With such a structure, the maximum stiffness or rigidity and strength would be achieved for a given thickness of surface sheet material and a given spacing therebetween. In the illustrated embodiment, a structure is provided which is a close approximation of the ideal structure. Even though there are a relatively large number of apertures 16 formed in the lower support member, a substantial amount of the material forming the lower support member remains in the portion 26 constituting a flat surface spaced from and parallel to the upper surface member. In fact, the apertures 16 constitute only about 37% of the area within the upright walls 21, so the remaining flat portion exceeds 60% of the total area within the upright walls 21. Further, since the legs 17 provide an interconnecting support between the upper and lower surfaces of the panel at closely spaced intervals, very good load supporting characteristics are provided over the entire upper surface of the panel. Consequently, a very efficient, relatively lightweight structure is provided which is capable of supporting substantial loads with relatively small deflections.

During the formation of the legs (described in greater detail below), material of the lower support member 14 is deformed to form a laterally extending, substantially uninterrupted cylinder 27 between the surface 28 and the location 29 beyond which the legs 17 extend. Further, the legs are provided with cross curvature between the locations 29 and the flanges 18, which gives them improved strength and rigidity to maintain a uniform spacing between the upper and lower surfaces.

Figure 5:
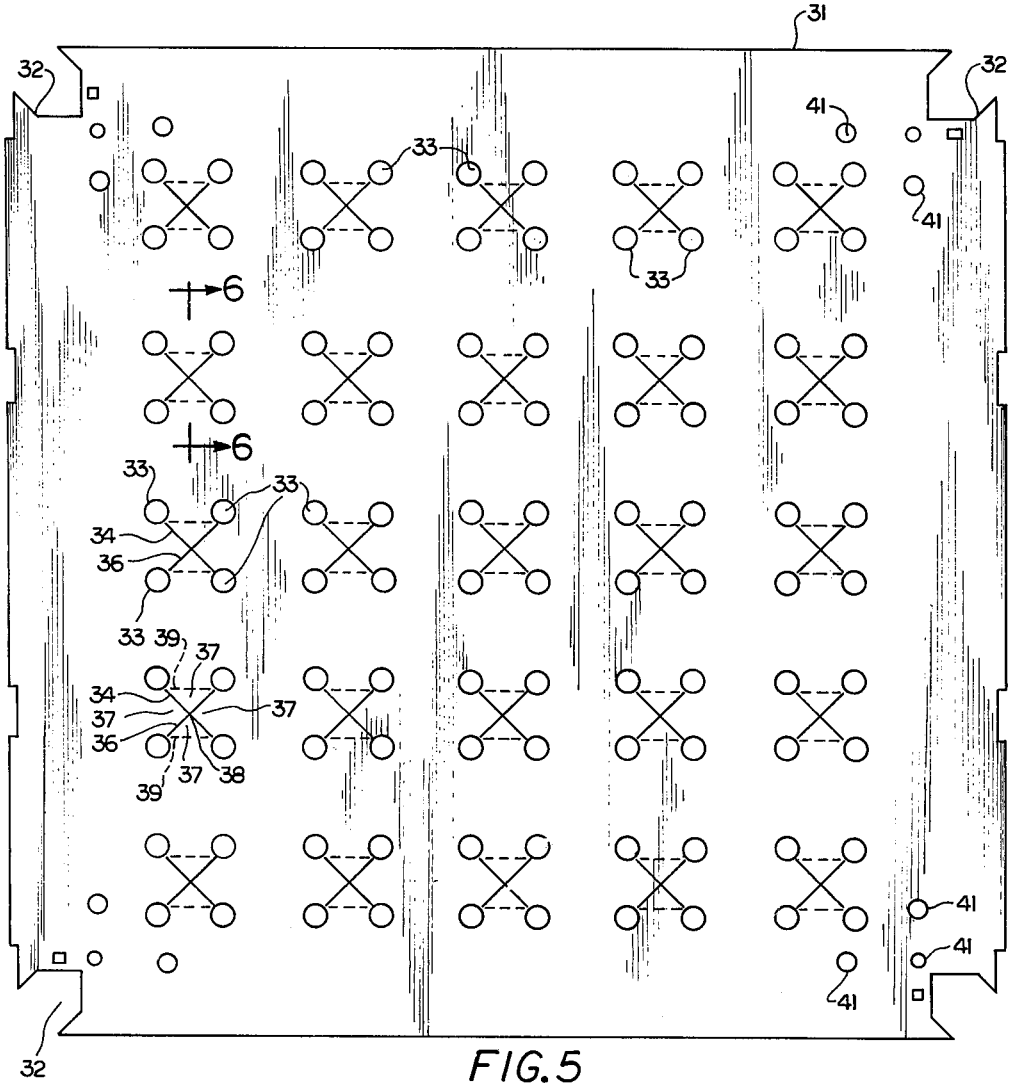
FIG. 5 is a plan view of the piece or blank from which the lower support member is formed prior to the operations in which the various apertures, legs, and flanges are formed.
Figure 6:
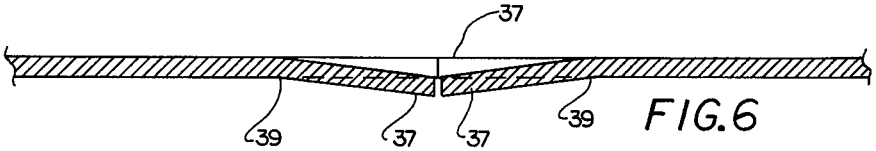
FIG. 6 is an enlarged, fragmentary view, taken along line 6—6 of FIG. 5.

The lower support member 14 is formed from a flat sheet of material or blank 31, illustrated in FIG. 5. Prior to a drawing operation, the sheet is punched and cut in the manner illustrated in FIGS. 5 and 6. The corners are notched at 32 so that the edges can be bent to form the wall 21 and the flange 22. Four small holes 33 are formed in the piece 31 in a square pattern at each location where an opening or aperture 16 will be formed. In addition, a pair of diagonal cuts 34 and 36, which extend perpendicular to each other and along the centerline of the associated opposite holes 33, are formed. Such cuts 34 and 36 extend toward the associated holes but end at a location spaced a small distance from the associated holes so that uncut material remains between the end of each cut and the adjacent opening 33. These cuts result in the formation of four V-shaped, projecting portions 37 which extend to a location at 38, where the two cuts 34 and 36 intersect. Two opposed projections 37 in each pattern are bent down slightly during the cutting operation, as indicated by the dotted lines 39 in FIG. 5. In addition, small holes 41 are formed adjacent to the corners of the blank to provide a pedestal connection.

It should be understood that a pattern of four holes 33 and two cuts 34 and 36 is formed at each location where an aperture 16 is to be subsequently formed, and in the preferred embodiment, the patterns are identical, and the intersections 36 are located along the centerlines of the subsequent apertures 16 to be formed.

The piece 31 is formed to its final shape, which includes bending the edges to form the walls 21 and flanges 32. Further, each of the apertures 16 is formed with tools and dies which cooperate to displace the material from the sheet to produce the legs 17, feet 18, and cylindrical portion 27. During such forming operation, the material of the piece 31 is drawn to a limited degree to provide a leg 17 of a length required to produce the desired spacing between the top and the bottom of the final panel.

During such drawing operation, the material between the ends of each of the cuts in the adjacent opening is ruptured after sufficient drawing has occurred to create rupturing stresses in the material. If longer legs are required, the spacing between the ends of the cuts 34 and 36 and the adjacent holes 33 is increased so that deeper drawing occurs before the rupture takes place.

As illustrated in FIG. 4, each leg has a substantial width extending past its center to a point at 42 and then tapers inwardly to the foot 18. Further, the legs have a cross curvature substantially along their entire length. The structure in which the legs have a cross curvature and a substantially constant width for a substantial portion of the their length results in a strong, rigid leg structure which is able to maintain a uniform spacing between the flat portion 26 of the support member and the upper surface member 13, even when substantial forces are applied to the panel in localized areas. Preferably, the legs 17 are inclined inwardly with respect to a line perpendicular to the surface member at a small angle a. In the illustrated embodiment, such angle is about 10 degrees. It has been determined that, by providing legs which do not extend perpendicularly to the plane of the panel surface, a greater rigidity is achieved.

After the lower support member is fully shaped, it is suitably secured to the upper surface member 13 by welds or the like. In the illustrated embodiment, each foot is welded at 19 to the upper surface member and the flanges 22 are also suitably welded, at least at intervals along their length.

Preferably, the apertures 16 adjacent to the wall 21 are spaced from such wall by adistance D1 (see FIG. 2) which is greater than the distance D2 between adjacent apertures in each row so that a beam-type structure that extends along each edge of the panel is wider than the beam-type structure which extends between the apertures 16. This ensures that excessive deflections will not occur when heavy loads are applied adjacent to the edges of the panels. In zones spaced from the edges, a beam system or network is provided between various rows in which the various beams between individual rows cooperate with each other to support loads applied to the panels and provide a high degree of rigidity. Such beam system prevents substantial deflection when loads are applied to the panels at locations spaced from the edges. Preferably, the spacing between the welds 19 of opposed legs 17 within a given aperture pattern is greater than the spacing between the welds of the adjacent legs 17 of adjacent apertures within each row.

In instances in which ventilation air is supplied through the panel, a pattern of openings is formed in the upper surface member to allow passage of air from the area below the panel. Because the lower support member is open, a substantial number of such openings can be provided for substantial flow of ventilating air.

With the present invention, a very small amount of material is removed from each piece 31 prior to the forming operation and substantially all of the material of such piece remains in the final panel structure to provide panel strength. Because of the improved efficiency of the structure provided by this invention, it is often possible to reduce the panel weight for given load rating. For example, a two-foot square panel in accordance with this invention, for one particular load rating, weighs about 24½ lbs., whereas, a comparable panel of the prior art meeting the same load rating weighed about 27¼ lbs. Further, the panel in accordance with the present invention is manufactured with substantially less scrap than such comparable prior art panel, and therefore has substantially lower material costs. Still further, with a panel in accordance with the present invention, it is normally not necessary to provide extra structural pieces in order to meet severe deflection specification requirements.

With this invention, a panel structure is provided which approaches the idealized structure to a great extent, and therefore, in many instances, can be produced with less material, less scrap, and lighter weight.

Although the preferred embodiment of this invention has been shown and described, it should be understood that various modifications and rearrangements of the parts may be resorted to without departing from the scope of the invention as disclosed and claimed herein.

What is claimed is:

1. A floor panel for elevated floors and the like having rectangular panels supported at their corners comprising a substantially rigid flat upper surface member formed of sheet metal, a substantially rigid lower support surface formed of sheet metal providing a substantially flat portion spaced from and substantially parallel to said upper surface member, said support member being formed with an array of circular apertures therein, the material originally located within said apertures being laterally deformed providing a plurality of integral legs having cross curvature throughout their entire lateral extend symmetrically positioned around said circular openings and extending substantially perpendicular to said flat portions to foot portions remote from said flat portions and substantially parallel thereto, said foot portions being welded to said upper surface member, said legs providing the sole connection between said lower support member adjacent to said apertures and said upper surface member, said legs cooperating to maintain the uniform spacing between said upper surface and said flat portion of said support member around said apertures so that said flat portion of said support member and said upper surface cooperate to provide a beam system resisting delection of said floor panel, opposed foot portions of a given aperture being spaced apart a distance greater than the spacing between adjacent foot portions of adjacent apertures, said lower support member being formed with side walls extending laterally from the edges thereof to said upper surface member and being secured thereto, the spacing between said apertures and said side walls being greater than between adjacent apertures.

2. A floor panel as set forth in claim 1, wherein said array of apertures form a plurality of perpendicular rows extending across said panel.

3. A floor panel as set forth in claim 1, wherein said legs provide a substantially uniform width to a location substantially adjacent to said foot portions.

4. A floor panel as set forth in claim 1, wherein the total area of said apertures is substantially less than one-half the area between said sidewalls.

5. A floor panel as set forth in claim 1, wherein said legs are inclined at an angle with respect to a line perpendicular to said members of about 10 degrees.

6. A method of forming floor panels adapted to be supported at their corners, comprising producing a blank of planar sheet metal having an array of patterns, said patterns including a plurality of spaced holes symmetrically arranged around a pattern center and a cut extending from said center toward each of said holes but terminating at a location spaced therefrom, deforming the material of said patterns to rupture the material between said cuts and said holes and to form a circular aperture substantially coaxial with said pattern center and a plurality of individual legs extending substantially perpendicular to said plane of said blank, each leg being provided with a foot portion at its extremity substantially parallel to said plane of said blank, and connecting said foot portions to a substantially rigid surface sheet, and arranging said arrays so that said legs provide a supporting connection between said sheets over substantially the entire extent of said panel.

7. A method of forming floor panels as set forth in claim 6, including bending the edges of said blanks to form laterally extending wall portions, and securing the extremities of said wall portions to said surface sheet adjacent to the edges thereof.

8. A method of forming floor panels as set forth in claim 6 wherein the spacing between said cuts and the adjacent holes is controlled to control the length of said legs and in turn the spacing between said sheets.

* * * * *